US005103260A

United States Patent [19]

Tompkins et al.

[11] Patent Number: 5,103,260

[45] Date of Patent: Apr. 7, 1992

[54] TONER DENSITY CONTROL FOR ELECTROPHOTOGRAPHIC PRINT ENGINE

[75] Inventors: E. Neal Tompkins, Atlanta; Jack N. Bartholmae, Duluth, both of Ga.

[73] Assignee: Colorocs Corporation, Norcross, Ga.

[21] Appl. No.: 605,085

[22] Filed: Oct. 29, 1990

[51] Int. Cl.[5] ..... G03G 15/00; G03G 15/01

[52] U.S. Cl. ..... 355/208; 355/246; 355/326

[58] Field of Search ..... 355/208, 246, 326; 118/665, 691; 346/157

[56] References Cited

U.S. PATENT DOCUMENTS

| | | | |
|---|---|---|---|
| 3,872,825 | 3/1975 | Davidson | 355/246 X |
| 4,277,162 | 7/1981 | Kasahara et al. | 355/208 |
| 4,365,894 | 12/1982 | Nakamura | 355/246 X |
| 4,816,924 | 3/1989 | Sekiya | 358/296 |
| 4,833,506 | 5/1989 | Kuru et al. | 355/208 |
| 4,903,051 | 2/1990 | Egawa et al. | 346/160.1 |
| 4,970,536 | 11/1990 | Haneda et al. | 355/157 |

*Primary Examiner*—Joan H. Pendegrass

*Attorney, Agent, or Firm*—Ross, Howison, Klapp & Korn

[57] ABSTRACT

A method for measuring and adjusting the toner density of black toner in a multi-color copy machine includes first developing and transferring a layer of yellow toner (132) onto the surface of a transfer belt (18). A cross-hatch pattern (134) of black toner is then developed and transferred onto the surface of the yellow toner layer (132) in a series of patches (138)-(148). The cross-hatch pattern (134) is comprised of vertical and horizontal bars (136) that are spaced a predetermined distance apart and have a predetermined width. A toner density sensor (40) is disposed over the surface of the transfer belt (18) to measure the toner density. The amount of toner deposited on a photoreceptor belt (12) is altered by varying the grid voltage on a charging corona (28) during the developing step to provide multiple toner densities for each of multiple patches (138)-(148). This data is then extrapolated to determine what the grid voltage on the charging corona (28) should be for the desired toner density.

20 Claims, 4 Drawing Sheets

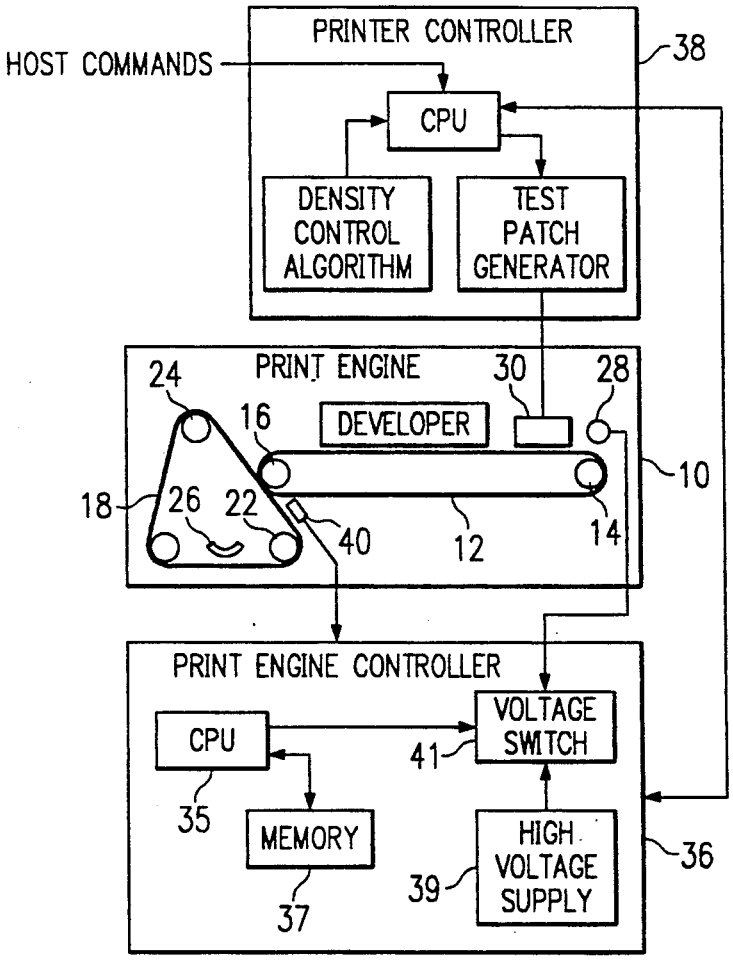
FIG. 1
FIG. 2
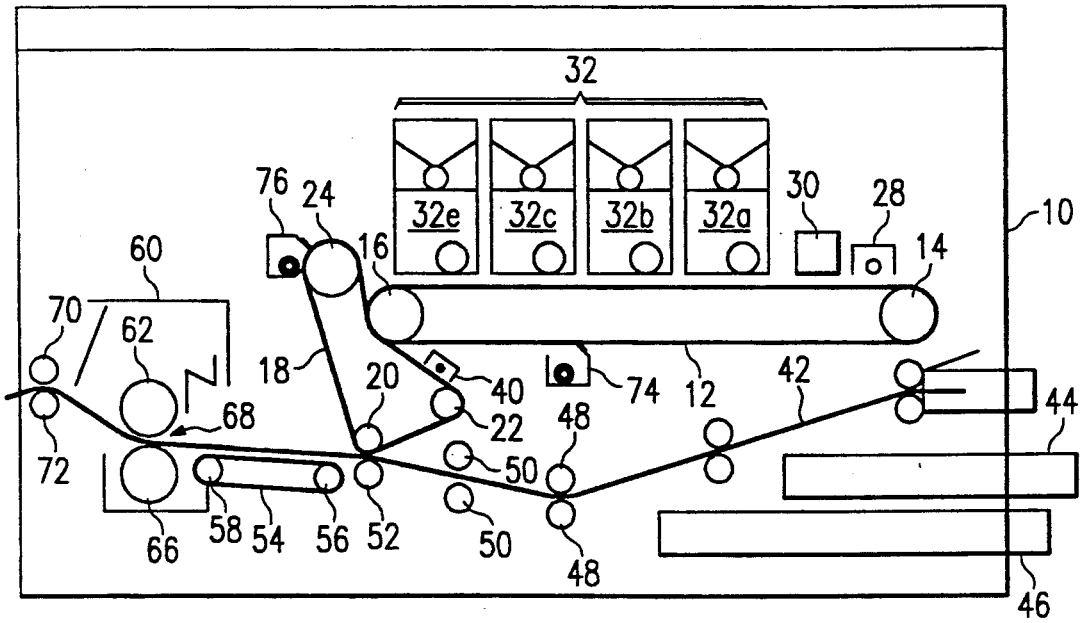

FIG. 6
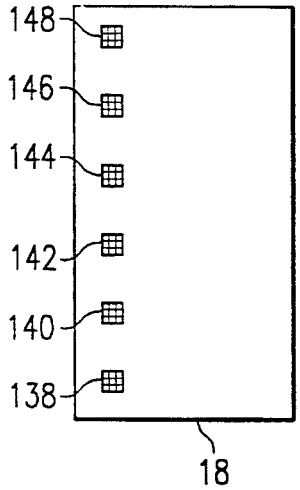
FIG. 9
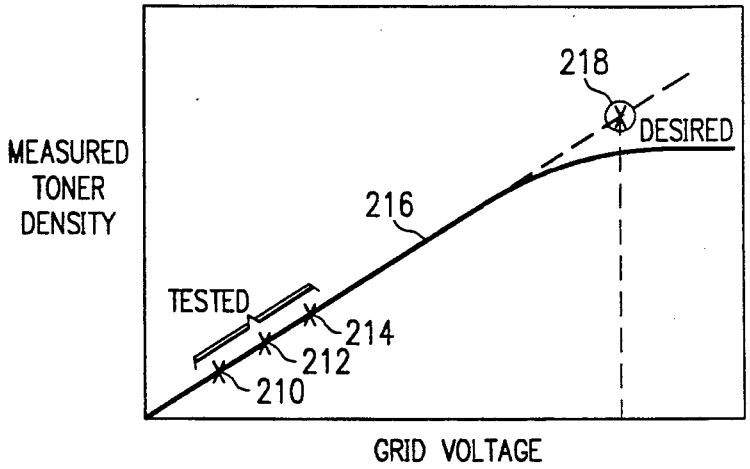
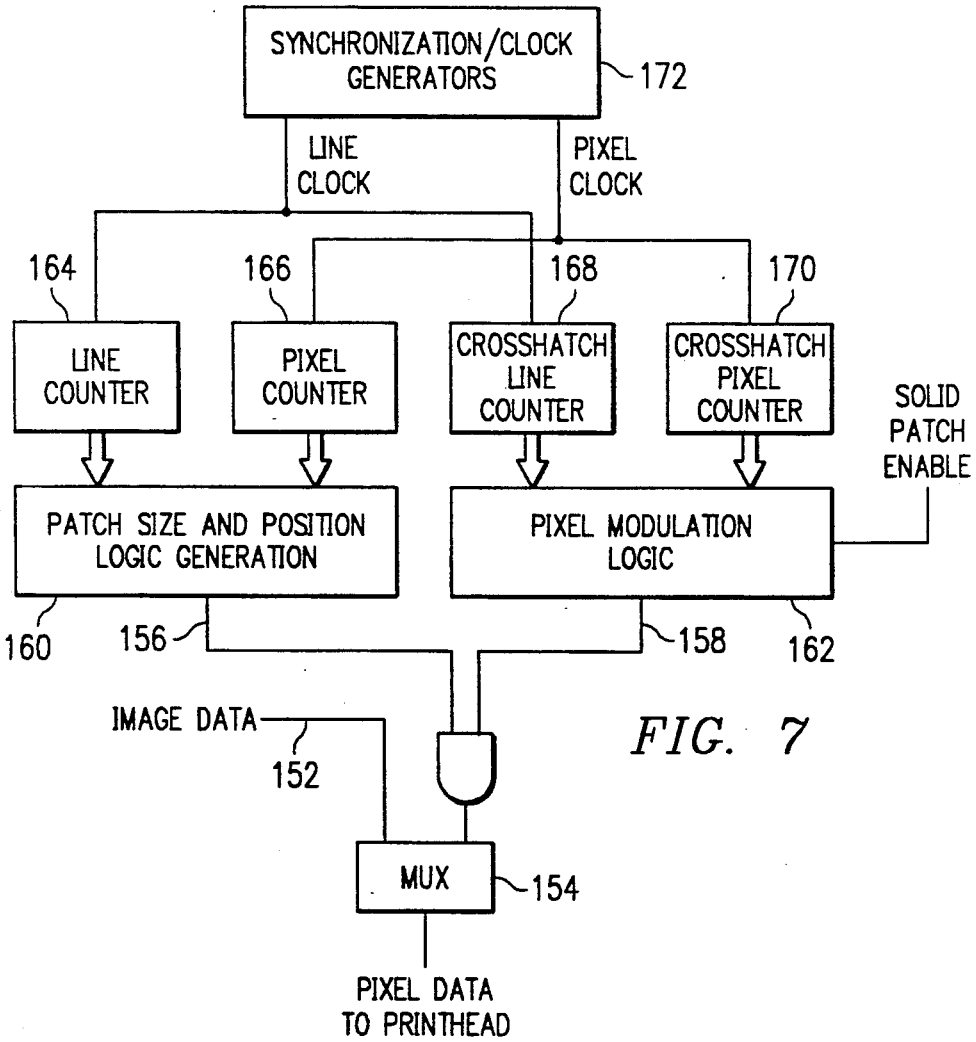
FIG. 7

TONER DENSITY CONTROL FOR ELECTROPHOTOGRAPHIC PRINT ENGINE

TECHNICAL FIELD OF THE INVENTION

The present invention pertains in general to print engines and, more particularly, to the control of the toner density.

BACKGROUND OF THE INVENTION

The print engine on printers and electrophotographic copy machines operates by forming a latent image on a photoconductive belt, depositing toner on the photoconductive belt, and then developing and transferring the developed image to an image receptor. There are a number of parameters in the print engine that are critical in providing high quality copies. One of these is the density of the toner that is applied to the photoconductive belt. The density is a function of the voltage that is imparted to the photoconductive belt and the exposure levels of the image. In particular, it is a function of the voltage on the belt. This voltage is typically formed with a charging corona that charges the photoconductive belt to a precalibrated level. However, as the characteristics of the belt, environmental factors, etc. change, the toner density also changes.

Previous solutions to the problem of varying toner density have primarily been directed toward measuring the toner density of a test patch and then comparing it to a predetermined value. Different voltages can be imparted to the photoconductive belt to vary the toner density of the patch, and then the voltage associated with the patch that most closely matches the desired toner density chosen as the operating voltage. This is stored in the control mechanism for the print engine. Subsequent copies made by the print engine will then utilize this voltage. Periodically, the test patch is again run and the voltage either changed or left alone.

One type of conventional toner density sensor is that utilizing infrared (IR) diodes and sensors that are operable to transmit infrared radiation onto a surface at an angle thereto, and then sense the reflected light energy. One type of sensor is disclosed in U.S. Pat. No. 4,652,115, issued to Palm, et al. on Mar. 24, 1987, and assigned to the present assignee. One problem that exists with use of this type of sensor is the signal-to-noise ratio that degrades significantly when trying to determine the density of a patch of black toner that is deposited directly on the surface of the transfer belt. The transfer belt is typically a dark color and, even though the radiation is at infrared wavelengths, a significant portion of this is absorbed by the underlying belt transfer, such that sufficient energy is returned to the sensor to provide reliable measurements. When measuring toner densities utilized in color reproduction, this does not present a problem. It is only with respect to the black toner that the measurement of toner density suffers from signal-to-noise problems.

In view of the above disadvantages, there exists a need for an improved method for monitoring the toner density for black toner, especially in a multi-color print engine utilizing a black toner as one of its primary colors.

SUMMARY OF THE INVENTION

The present invention disclosed and claimed herein comprises a method for measuring toner density in an electrophotographic print engine. The method includes first providing an image receptor for carrying developed images. The optical properties of a select portion of the image receptor are then modified. A first developed image is then disposed on the select portion of the image receptor, which first developed image was developed with a first toner. The select portion of the image receptor that was modified has reflective properties that are higher than that of the first toner. The toner density of the first developed image that is disposed over the select portion of the image receptor is measured by reflecting light off the surface of the first developed images and then detected and compared with a reference.

In another aspect of the present invention, the image receptor comprises a transfer belt which has the optical properties thereof modified by first transferring a layer of toner on the surface thereof. This provides a base layer which has reflective properties that are higher than that of the image receptor, the base layer typically utilizing a yellow toner. The first toner layer is black toner which is disposed over the yellow toner.

In yet another aspect of the present invention, the first image is formed in a pattern that has a plurality of select voids disposed therein. The voids allow the second toner to show through the first toner and therefor increase the signal-to-noise ratio thereof. The step of measuring the toner utilizes a sampling technique wherein a number of samples are taken over the surface of the second image and then averaged.

In a yet further aspect of the present invention, a photoconductive member is provided that is charged to a predetermined voltage. The base layer of toner is formed by exposing and developing a first image or patch with the yellow toner and then transferring it to the image receptor. The first developed image is then exposed and developed on the photoconductive member and then transferred to the image receptor over the yellow toner layer. The measured toner density is then compared to a reference and then a desired voltage determined to which the photoconductive member is to be charged to provide a desired toner density.

BRIEF DESCRIPTION OF THE DRAWINGS

For a more complete understanding of the present invention and the advantages thereof, reference is now made to the following description taken in conjunction with the accompanying Drawings in which:

FIG. 1 illustrates a schematic view of a printer utilizing the toner density control system of the present invention;

FIG. 2 illustrates a structural view of the print engine;

FIG. 6 illustrates a top view of multiple patches, each patch having a different toner density disposed thereon;

FIG. 7 illustrates a logic diagram for the generation of the pixels that are provided to the printhead;

FIG. 9 illustrates a graph of the toner density and the grid voltage for the charging corona.

DETAILED DESCRIPTION OF THE INVENTION

Figure 3:
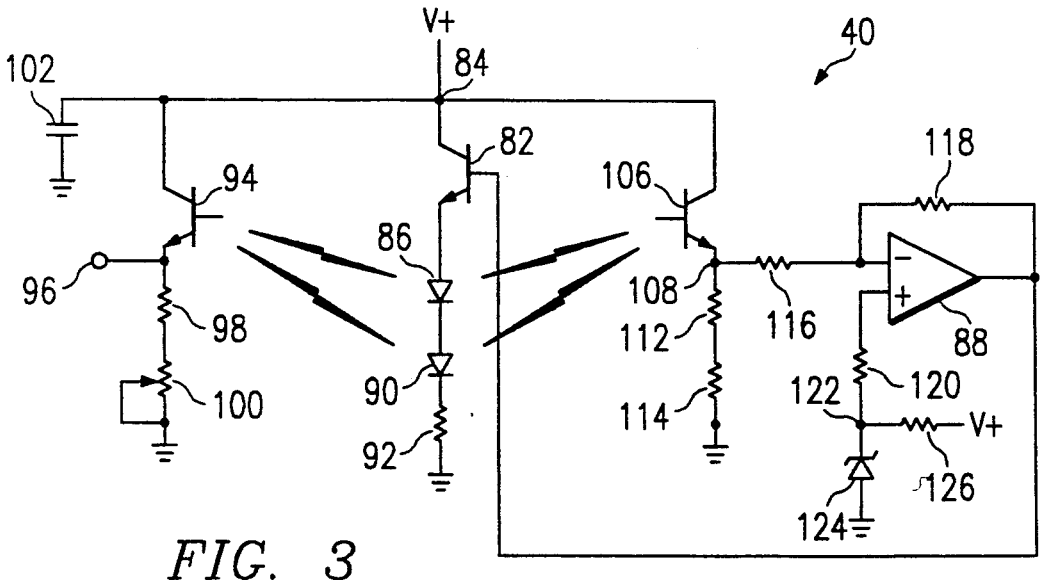
FIGURE 3 illustrates a schematic diagram of the density sensor.

Referring now to FIG. 1, there is illustrated a block diagram of a multi-color printer that operates in accordance with the present invention. At the heart of the printer is a print engine 10. The print engine 10 has a photo-receptor belt 12 that is rotated about an idler roller 14 and a powered roller 16. The photo-receptor belt 12 has associated therewith tension adjustment apparatus (not shown) which forms a part of the printer. A latent image is formed on the surface of the photo-receptor belt 12 and then transferred to a transfer belt 18. The transfer belt 18 moves about idling rollers 20 and 22 and a powered roller 24. A grounding plate 26 is provided which forms a part of the composite image transfer station at which a complete developed composite image is transferred to a final image receptor. The timing and control mechanisms for driving the two belts 12 and 18 is illustrated in U.S. Pat. No. 4,847,660, issued to M. Wheatley, Jr., et al. on July 11, 1989, and assigned to the present assignee, which patent is incorporated herein by reference.

A conventional charging corona 28 charges the photo-receptor belt 12 to a uniform surface charge condition prior to exposure to light, and that portion of the belt then passes under a printhead 30. The printhead 30 is a light emitting diode (LED) array. The printhead 30 is similar to the image scanner in a copy machine and also a laser printhead in a laser printer. The printhead 30 is operable to expose the photo-receptor belt 12 to a predetermined pattern of "pixels", which are defined as the smallest discernible picture element in a given reproduction.

After exposure, the surface of the photo-receptor belt 12 passes beneath a plurality of development stations which are represented by a box 32. In the preferred embodiment, there are three development stations included in box 32 that contain the full-color process toners, yellow, magenta and cyan, with an additional station provided for black toner. Details of the developer are described in U.S. Pat. No. 4,652,115, issued to Palm, et al. on March 24, 1987, and assigned to the present assignee, which patent is incorporated herein by reference. The developed image is then transferred to the transfer belt 18 which functions as image receptor to "build up" the various layers of a multi-colored image.

The print engine 10 is controlled by print engine controller 36. The print engine controller 36 determines the voltage that is applied to the charging corona 28 and also interfaces with a printer controller 38 that is operable to generate the pixel information for the printhead 30. The printer controller 38 is operable to receive external host commands that are utilized to send program information to the printer controller 38 that reproduces the image on the photo-receptor belt 12 as a latent image.

A density sensor 40 is provided which is disposed adjacent to the transfer belt 18 and which comprises an input to the print engine controller 36. The density sensor 40, as will be described in more detail hereinbelow, provides information to the print engine controller 36 that is utilized to set the voltage on the charging corona 28 in the normal copying cycle for each of the toners. A CPU 35 is provided in the print engine controller that receives the information from the sensor 40 and compares it with predetermined reference data in a memory 37 to determine the measured toner density. As will be described hereinbelow, the measured toner density is extrapolated to define the voltage that is required for the charging corona 28 to provide a desired toner density. This voltage is selected from a high voltage power supply 39 through a switching device 41.

Referring now to FIG. 2, there is illustrated a more detailed cross-sectional diagram of the print engine 10. Paper is input along a paper path 42, which paper is retrieved from a paper tray 44 or a paper tray 46. The paper travels through a transfer station comprising a transfer roller 52 that is disposed proximate to the idler idling roller 20 and then to an intermediate transfer belt 54 which is disposed on one end around an idler roller 56 and on one end thereof around a powered roller 58. The intermediate transfer belt 54 acts as a guide to guide the paper into a fuser mechanism 60. The fuser mechanism 60 has two rollers 62 and 66 with a nip 68 disposed therebetween for receiving the paper. At least one of the rollers 62 or 66 is heated to provide the fusing operation The paper exits and is disposed in the nip of two rollers 70 and 72 for exit from the print engine 10.

The developer is comprised of four toner modules **32*a*, 32*b*, 32*c* and 32*e*. The toner modules 32*a*–32*c* represent the colors, yellow, magenta and cyan, with the toner module 32*e* representing the black toner. Additional toner modules can be utilized for custom toners. The details of these toner modules are contained in the specification of the Palm patent, which was incorporated herein by reference. The toner modules may be positioned in a downwardly pointing orientation over the photo-receptor belt 12** or in an upward position.

A cleaning station 74 is provided for the photoreceptor belt 12 and a cleaning station 76 is provided for the photo-transfer belt 18. These typically comprise a cleaning blade and/or cleaning roller.

Although the print engine controller 36 has been illustrated for a printer application, it should be understood that a control mechanism for a copying application would be similar. In this type of application, the printhead 30 would be replaced with an image scanner. The image scanner would then be controlled to operate in a special mode for monitoring toner density.

Referring now to FIG. 3, there is illustrated a schematic diagram of the optical sensor 40 that is disposed proximate to the transfer belt 18. An NPN transistor 82 has the collector thereof connected to a positive supply node 84, the emitter thereof connected to the anode of a diode 86 and the base thereof connected to the output of an operational amplifier 88. The cathode of the diode 86 is connected to the anode of a second diode 90, the cathode of which is connected to ground through a resistor 92. Diodes 86 and 90 are light emitting diodes (LED) that are operable in the infrared spectrum to emit infrared radiation. An optical-detector transistor 94 is provided, having the collector thereof connected to the positive node 84 and the emitter thereof connected to an output terminal 96. The emitter of transistor 94 is also connected through a resistor 98 to one side of a variable resistor 100. Variable resistor 100 has a wiper arm connected thereto to vary the value of resistor 100. The resistor 100 has the other side thereof connected to ground. The collector of transistor 94 is also connected to one side of a filter capacitor 102, the other side of which is connected to ground. Transistor 94 provides the detection operation of the detector 40 and it is typically disposed a predetermined distance from the diodes 86 and 90. Typically, diodes 86 and 90 are disposed such that they emit radiation at an angle with respect to the incident on the surface of the transfer belt 18, and the detector transistor 94 is disposed such that it is also disposed at an angle with respect to the surface of the transfer belt 18. In this manner, the light emitted by diodes 86 and 90 is reflected off of the surface of the transfer belt 18 at an angle. The adjustment of the positions for both the diodes 86 and 90 and the detector transistor 94 are optimized to provide the best signal-to-noise ratio. The voltage measured on the output of the emitter of transistor 94 on terminal 96 provides and indication of the detected voltage.

A second detector transistor 106 is provided having the collector thereof connected to the positive node 84 and the emitter thereof connected to a node 108. Node 108 is connected to ground through two series-connected resistors 112 and 114. Resistor 114 is variable and has a wiper associated therewith. The node 108 is also connected to the negative input of operational amplifier 88 through a resistor 116. The negative input of operational amplifier 88 is connected through a resistor 118 to the output of operational amplifier 88. The positive output of operational amplifier 88 is connected through a resistor 120 to a reference node 122. Reference node 122 is connected to the cathode of a zenor diode 124, the anode of which is connected to ground. The node 122 is also connected to the positive supply through a voltage 126. Transistor 106 and the operational amplifier 88 provide a feedback control voltage for transistor 82 to maintain the light emitted by diodes 86 and 90 at a constant level.

In operation of the present invention, when it is desired to monitor the toner density for the black toner, the first step is to deposit a layer of toner onto the transfer belt 18 that is of a lighter color than the transfer belt 18 itself. In the preferred embodiment, a layer of yellow toner is developed and transferred to the transfer belt 18 followed by a layer of black toner. Since the black toner now has a relatively light color disposed therebeneath, a much higher signal-to-noise ratio exists as compared to depositing the black toner directly onto the transfer belt 18.

Figure 4:
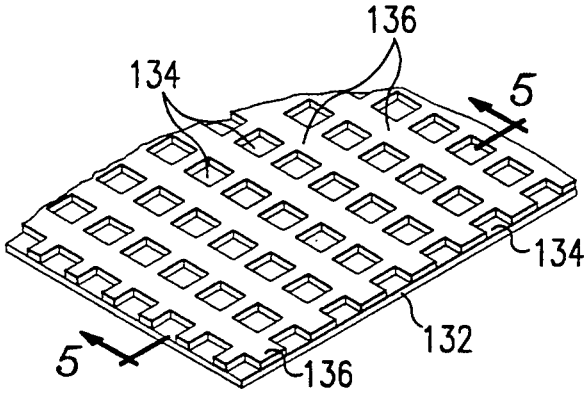
FIG. 4 illustrates a top view of the pattern for the black toner disposed over a layer of yellow toner.

Referring now to FIG. 4, there is illustrated the preferred embodiment of the pattern of the black toner disposed on top of the yellow toner base layer. A layer of yellow toner 132 is illustrated that is disposed to a thickness that will ensure that it is providing more than adequate coverage. Thereafter, a solid layer of black toner could be disposed on the surface of the layer 32 but, in the preferred embodiment, a crosshatched pattern of black toner 134 is disposed on the surface of the yellow toner layer 132. It should be understood that the yellow toner layer 132 could be another color, and it could even be a custom color. It is only important that it provide a modification to the optical properties on the surface of the transfer belt 18 that results in an improved signal-to-noise ratio in the black toner density measurement.

In both directions, there are disposed a plurality of bars that are four pixels wide which are disposed four pixels apart. It has been determined that this provides an improved signal-to-noise ratio in that less than a solid black toner surface is presented to the density sensor 40. By sampling the surface at a plurality of points on the surface (sixteen in the preferred embodiment) and then averaging the samples, an accurate measurement of toner density can be determined.

Figure 5:
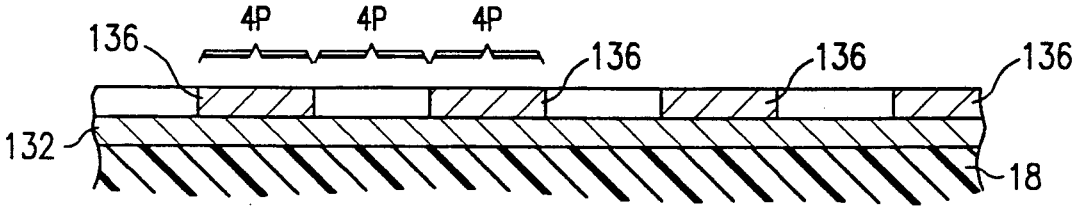
FIG. 5 illustrates a cross-sectional diagram of the patch of FIG. 4.

Referring now to FIG. 5, there is illustrated a cross-sectional view of the combined crosshatch pattern 134, yellow toner layer 132 and transfer belt 18. The crosshatch pattern is comprised of horizontal bars 135 and vertical bars 136. In the vertical direction, each of the bars 136 is dimensioned such that it is four pixels wide and the bars 136 are disposed apart by a distance of four pixels. Each pixel is defined by an LED in the LED array of the printhead 30 and its associated illumination pattern. The LEDs are modulated to provide the crosshatch pattern.

Referring now to FIG. 6, there is illustrated an enlarged view of the pattern that is deposited onto the transfer belt 18. The pattern is comprised of a plurality of patches 138, 140, 142, 144, 146 and 148. Each of the patches 138–148 is formed with a different surface voltage on the photo-receptor belt 12 such that the density of the black toner on the yellow layer 132 varies. Since the grid voltage that is applied to the charging corona 28 is known, this voltage can be varied in steps and then a measurement of toner density made for each of the patches 138–148. The measurements can be compared against a desired toner density and then the voltage corresponding to the desired toner density selected. As will be described in more detail hereinbelow, the toner density is difficult to measure at the desired toner density and, therefore, measurements are made at lower toner densities and then these measurements extrapolated to determine what the grid voltage for the actual toner density should be during normal operation.

The patches are dimensioned as small as possible to conserve toner. In the preferred embodiment, the patches are dimensioned to be two centimeters in the x-direction (across the photo-receptor belt 12) and three centimeters in the y-direction (lengthwise along the photo-receptor belt 12). The centers of the patches are disposed apart a dimension of ten centimeters, resulting in the edges of the patches being separated by seven centimeters. The grid voltage on the charging corona 28 in the preferred embodiment is stepped in one hundred volt increments resulting in corresponding one hundred volt increments on the surface of the photo-receptor belt 12. A delay exists between the time the charging corona 28 is incremented in voltage and the surface voltage on the photo-receptor belt stabilizes. The seven centimeter distance between patches provides a sufficient amount of time at the travel speed of the photo-receptor belt 12 to allow the surface voltage thereon to stabilize between voltage increments on the charging corona 28.

Referring now to FIG. 7, there is illustrated a logic block diagram for modulating the pixel data that is input to the printhead 30, which data is input in a serial stream. Typically, this serial stream is shifted into the LED array and then latched onto the LEDs in a periodic manner. The original image data is input on a line 152 to a two input multiplexer 154, this image data being a solid patch during the toner density measurement operation. The multiplexer 154 is controlled by input that is connected to the output of an AND gate 155, having an input 156 and an input 158. The input 156 is derived from the output of a combinatorial logic block 160 that determines what the patch size and position is. The line 158 is derived from the output of a combinatorial logic block 162 that determines the pixel modulation. The logic block 160 receives as an input the output of a line counter 164 and also the output of a pixel counter 166. The logic block 162 receives as an input the output of a crosshatch line counter 168 and also the output of a crosshatch pixel counter 170. The line counter 164 and the crosshatch line counter 168 receive a line clock that is output by a clock generator circuit 172, the clock generator circuit 172 providing the general synchronization and clocks for the print controller 38. The pixel counter 166 and the crosshatch pixel counter 170 are connected to a pixel clock which is generated by the clock generator circuit 172.

In operation, the logic block 160 determines where the patch for both the yellow toner layer 132 and the black toner layer 136 are disposed. Within the location of the patch, a high output will result, the image data input also being a logic high. The logic block 162 is operable to blank the pixels that are not exposed in the crosshatch pattern, depending on the position of the line in one direction and the pixel number in the other and orthogonal direction.

Figure 8:
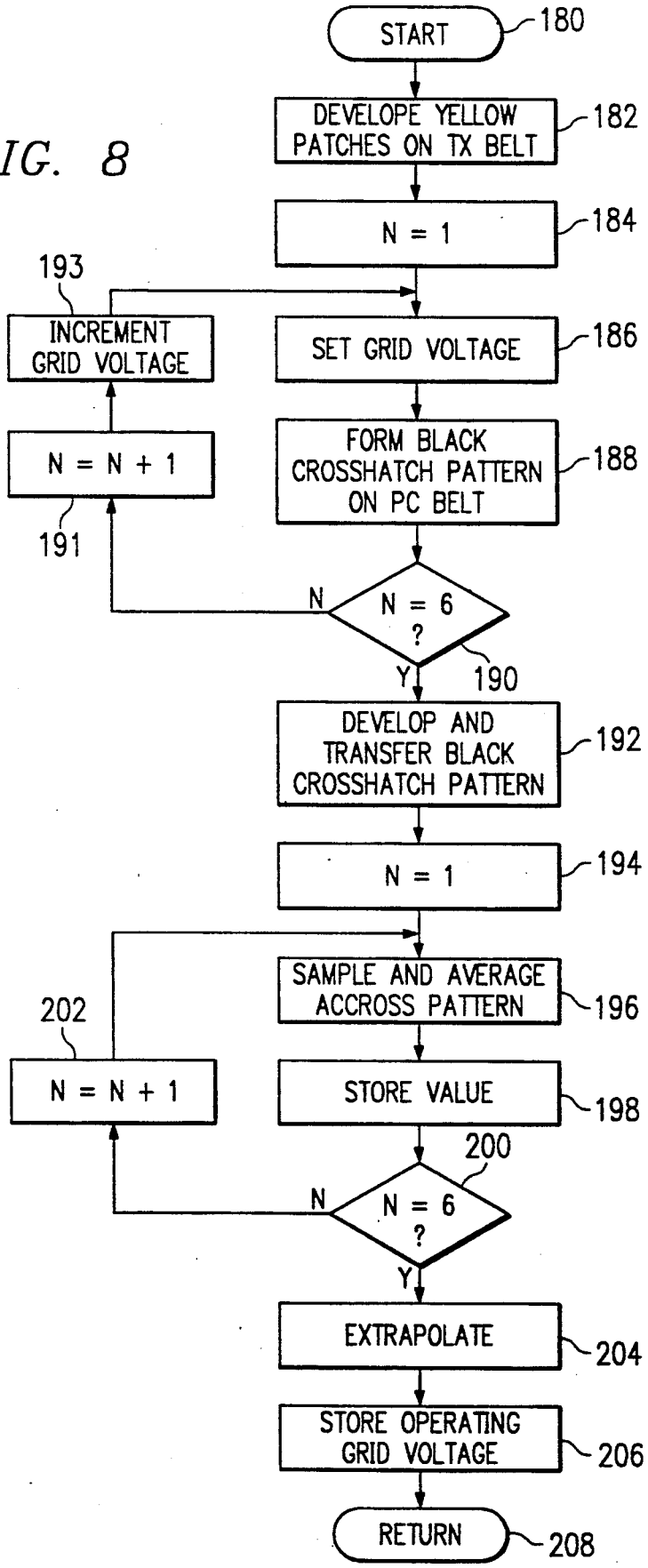
FIG. 8 illustrates a flow chart for the toner density control operation to develop the surface voltage for the photoconductive belt.

Referring now to FIG. 8, there is illustrated a flow chart for the operation of the toner density control system. The measurement operation block is initiated at a start block 180 and then proceeds to a function block 182. The function block 182 indicates the step whereby the yellow patches on the transfer belt are formed by a developing and transfer step. During this step, the voltage is adjusted such that the toner is of sufficient thickness with little or no effect realized by the transfer belt 18 during the toner sensing operation. The program then flows to a function block 184 to set the value of a parameter "N" to one. The program then flows to a function block 186 to set the grid voltage on the charging corona 28 to a first value that is a function of the value of "N". The program then flows to a function block 188 to form the black crosshatch pattern on the yellow patch. This pattern is first formed on the photoreceptor belt 12 and then transferred to the transfer belt 18 as illustrated in FIG. 6.

The program flows through a decision block 190 to determine whether the value of "N" is equal to six. If not, the program flows along a "N" path to a function block 192 to increment the value of "N" and then to a function block 194 to increment the grid voltage by a predetermined increment. The output of function block 194 then goes back to the input of function block 186 to set the grid voltage at this higher incremented value. Another crosshatch pattern is formed on the photoreceptor belt 12, and spaced apart from the previous one. This continues until six crosshatch patterns in three different areas with six different grid voltages have been disposed on the photo-receptor belt 12. The program then flows from the decision block 190 along the "Y" path to a function block 192 to develop and transfer the black crosshatch pattern to the transfer belt 18. The program then flows to a function block 194 to set the value of "N" equal to one and then to a function block 196 to sample and average across each of these patches and the associated crosshatch pattern for the black toner. The value for each patch is stored, as indicated by a function block 198, and then the program flows to a decision block 200 to determine if the value of "N" is equal to six. If not, the program flows back along an "N" path to a function block 202 to increment the value of "N" and then back to the input of function block 196 to sample and average the toner density across the next segment. This continues until the value of "N" is equal to six.

After the toner density has been determined for each of the segments on the transfer belt 18, the program flows along a "Y" path from the decision block 200 to a function block 204 to determine what grid voltage should be utilized to provide the desired density. This can either be an actual measurement of toner density for an actual tested grid voltage, interpolation between data points or the data can be extrapolated from data corresponding to grid voltages that are lower or higher than the desired grid voltage. After determining the desired grid voltage, a value is stored, as indicated by a function block 206, and then the program flows to a return block 208.

Referring now to FIG. 9, there is illustrated a graph of the toner density and the grid voltage for the charging corona 28. Three test points, 210, 212 and 214, are illustrated along a line 216. The line 216 represents the variation of toner density with grid voltage. However, the actual reliability of the measurement of toner density for thick toners becomes very difficult when utilizing a reflective type measurement. This is due to the fact that the toner becomes so thick that there is no distinction made as the toner density increases. Therefore, the test points, 210, 212 and 214, are tested for relatively low toner densities at relatively low grid voltages on the charging corona 28. This data is then extrapolated up to a desired toner density at a point 218 on a dotted line. The solid line represents the measured toner density, which at the desired grid voltage at point 218 is in error.

In summary, there has been provided a method for measuring toner density for black toner. The method includes first disposing a patch of yellow toner onto the transfer belt and then developing a patch of black toner over the surface of the yellow toner. The underlying yellow layer provides a highly reflective layer that results in an increased signal-to-noise ratio for a toner density measurement. The toner density is then measured for different thicknesses of black toner on a reference thickness of yellow toner and then the desired thickness determined by either extrapolating the measured data or adjusting the grid voltage of the charging corona until the desired toner density is achieved. The value is then stored for a grid voltage corresponding to a desired toner density for use in the operation of the print engine.

Although the preferred embodiment has been described in detail, it should be understood that various changes, substitutions and alterations can be made therein without departing from the spirit and scope of the invention as defined by the appended claims.

What is claimed is:

1. A method for measuring toner density in an electrophotographic print engine, comprising:

providing an image receptor for receiving developed images;

selectively modifying the optical properties on the surface of a select portion of the image receptor during a toner density measuring operation;

disposing a first developed image over the select portion of the image receptor during the toner density measuring operation, which first developed image was developed with a first toner having a first toner density; and measuring the toner density of the first developed image during the toner density measuring operation by reflecting light off the surface of the first developed image, measuring the intensity of the reflected light and comparing the measured intensity of the reflected light with a reference to determine the density of the first toner.

2. The method of claim 1, wherein the step of modifying the optical properties on the surface of the image receptor comprises disposing a base layer developed image to the select portion of the receptor, which base layer developed image was developed with a second toner having higher reflective properties than the first toner.

3. The method of claim 2, wherein the first toner is a black toner and the second toner is yellow toner.

4. The method of claim 1, wherein the first developed image comprises a pattern having select voids of the first toner therein to thereby expose the modified surface of the select portion of the image receptor.

5. The method of claim 1, wherein the step of measuring toner density comprises:

irradiating the surface of the first developed image with light at a predetermined frequency;

detecting the level of the reflected light from the surface of the first developed image; and comparing the detected level of reflected light to a predetermined reference to determine if it is within acceptable boundaries.

6. The method of claim 1 and further comprising:

providing a photoconductive member;

charging the photoconductive member to a predetermined voltage;

exposing and developing the first developed image on the photoconductive member with the first toner to provide the first developed image;

the step of disposing the first developed image comprising transferring the first developed image from the photoconductive member to the image receptor at the modified select portion thereof; and determining from the measured toner density a desired voltage to which the photoconductive member is to be charged to provide a desired toner density.

7. The method of claim 6 wherein the image receptor is an intermediate transfer member that is operable to hold multiple layers of toners and transfer the multiple layer of toners to a final image receptor.

8. The method of claim 7 wherein the intermediate transfer member is a transfer belt, and the photoconductive member is a photoconductive belt.

9. The method of claim 1, wherein:

the step of modifying the optical properties of a select portion of the image receptor comprises modifying the optical properties of a plurality of defined patches on the surface of the image receptor;

the step of disposing the first developed image on the image receptor comprises disposing a plurality of first developed images each over one of the patches, with each of the first developed images having a different toner density; and the step of measuring the toner density comprises measuring the toner density of each of the first developed images over each of the patches.

10. The method of claim 9 and further comprising:

comparing the measured toner densities of each the plurality of first developed images to a reference; and selecting the one of the plurality of first developed images and the associated toner density that is closest to the desired toner density.

11. The method of claim 9, wherein the toner densities of the plurality of first developed images is less than a desired toner density in the step, and further comprising extrapolating the measured toner density data to define the thickness of the toner that will provide a desired toner density at a thickness greater than the thickness of the toner on the plurality of first developed images.

12. A method for measuring toner density in an electrophotographic print engine, comprising:

providing a photoconductive belt;

providing an image receptor;

exposing and developing a first image on the photoconductive belt with a first toner;

transferring the first image from the photoconductive belt to the image receptor;

exposing and developing a second image on the photoconductive belt with a second toner, the first toner having higher reflective properties than the first toner;

transferring the second image from the photoconductive belt to the image receptor such that a portion of the second image overlaps the first image;

irradiating the overlapping portion of the first and second images with light at a predetermined frequency;

detecting light reflected from the surface of the overlapping portion of the first and second images; and determining the density of the second toner in the second image by comparing the level of the detected light with a known reference.

13. The method of claim 12 wherein the step of exposing and developing the second image on the photoconductive belt comprises:

charging the surface of the belt to a predetermined voltage level in the area on which the second image is to be exposed and developed;

exposing the belt with a light source to define a latent image on the surface of the photoconductive belt; and developing the latent image with the second toner to form the second image, the toner density of the second toner in the developed second image being a function of the voltage to which the photoconductive belt is charged.

14. The method of claim 13, wherein:

the step of charging the photoconductive belt to a predetermined voltage comprises charging the photoconductive belt to a plurality of different voltages on different regions of the photoconductive belt such that the toner density at each of the different regions will vary and wherein the second developed image overlaps at least a portion of the first developed image at each of the different regions when the first developed image and second developed image are transferred to the image receptor; and the step of detecting the light reflected from the second developed image comprises detecting the light reflected from the surface of the second developed image that overlaps the first developed image in each of the regions; and the step of determining comprising determining the toner density of the second toner in the second developed image at each of the regions.

15. The method of claim 14 and further comprising:

comparing the determined toner densities with a reference and determining a desired toner density and the associated desired voltage that is required to be disposed on the photoconductive belt to provide the desired toner density; and storing information regarding the desired voltage to which the photoconductive belt is to be charged to provide the desired toner density.

16. The method of claim 13 and further comprising determining the voltage to which the photoconductive belt must be charged to provide a predetermined toner density when developing a latent image with the second toner, the step of determining including extrapolating the measured toner density and associated voltage to determine the voltage on the photoconductive belt necessary to provide the predetermined toner density.

17. The method of claim 13 wherein the first toner is yellow and the second toner is black.

18. The method of claim 13 wherein the portion of the second image overlapping the first image on the image receptor has a plurality of voids disposed therein to expose the surface of the underlying first image.

19. A method for measuring toner density in an electrophotographic print engine, comprising:

providing an image receptor for receiving developed images;

modifying the optical properties on the surface of a select portion of the image receptor by disposing a base layer developed image to the select portion of the image receptor, which base layer developed image was developed with a secondary toner;

disposing a first developed image over the select portion of the image receptor, which first developed image was developed with a primary toner having a first toner density, said primary toner having higher reflective properties than said primary toner; and measuring the toner denisty of the first developed image by reflecting light off the surface of the first developed image, measuring the intensity of the reflected light and comparing the measured intensity of the reflected light with a reference to determine the density of the primary toner.

20. The method of claim 10, wherein the primary toner is a black toner and the secondary toner is yellow toner.

* * * * *